US006474897B1

(12) United States Patent
To

(10) Patent No.: US 6,474,897 B1
(45) **Date of Patent: *Nov. 5, 2002**

(54) RING BINDER HAVING ACTUATING LEVER WITH CUSHION MEMBER

(75) Inventor: Chun Yuen To, Kauto Shan Shatin (HK)

(73) Assignee: World Wide Stationery Mfg. Co., Ltd., Kwai Chung (HK)

( * ) Notice: Subject to any disclaimer, the term of this patent is extended or adjusted under 35 U.S.C. 154(b) by 84 days.

This patent is subject to a terminal disclaimer.

(21) Appl. No.: 09/678,094

(22) Filed: Oct. 4, 2000

Related U.S. Application Data

(63) Continuation-in-part of application No. 09/539,712, filed on Mar. 31, 2000.

(51) Int. Cl.[7] ..... B42F 13/20

(52) U.S. Cl. ..... 402/38; 402/4; 402/26; 402/31; 402/36; 402/38; 402/39; 402/41; 402/46; 128/206.27

(58) Field of Search ..... 402/4, 31, 36, 402/38, 39, 26, 41, 46; 128/206.7

(56) References Cited

U.S. PATENT DOCUMENTS 5,234,276 A * 8/1993 Semerjian ..... 402/38
6,280,114 B1 * 8/2001 To ..... 402/38
2001/0026726 A1 * 10/2001 To ..... 402/41

* cited by examiner

*Primary Examiner*—A. L. Wellington
*Assistant Examiner*—Mark T. Henderson
(74) *Attorney, Agent, or Firm*—Birch, Stewart, Kolasch & Birch, LLP

(57) ABSTRACT

A ring binder includes a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members. Each actuating lever includes a tab having a cushion member formed thereon, for example by molding. The tab has an aperture therein, and cushion material enters the aperture during molding to secure the cushion member onto the tab. The cushion member is engaged by the fingers of a user to pivot the actuating lever in order to move the ring members between the open position and the closed position. The cushion member is a soft pad of material such as plastic. The cushion member provides improved tactile characteristics to the actuating lever, making the actuating lever comfortable to use. The cushion member also minimizes the feedback of undesirable shock forces produced by the snap action of the rings when opening and closing the rings.

20 Claims, 4 Drawing Sheets

RING BINDER HAVING ACTUATING LEVER WITH CUSHION MEMBER

This application is a Continuation-in-Part of application Ser. No. 09/539,712, filed Mar. 31, 2000, the entire contents of which are hereby incorporated by reference.

BACKGROUND OF THE INVENTION

1. Field of the Invention

The present invention relates to a ring binder having an improved actuating lever for opening and closing rings of the ring binder, and more particularly, to an actuating lever having a cushion member for improving tactile characteristics of the actuating lever.

2. Description of the Background Art

Ring binders are known which have a substantially rigid upper plate supporting a pair of hinged leaves pivotally movable relative to each other. A number of half-rings are attached to each of the hinged leaves so that pivoting of the hinged leaves will open or close the half-rings in a snapping motion. This motion is caused by movement of actuating levers located at each end of the ring binder.

Conventional actuating levers are typically formed of stamped metal having sufficient rigidity to transmit the forces necessary to open and close the rings. However, the snapping action produces undesirable shock forces which are transmitted to the fingers of the user. Also, because the actuating levers are formed of metal which it typically nickel plated, the actuating levers can become slippery, causing the user's fingers to slip off of the actuating lever, possibly resulting in injury to the user. Additionally, conventional actuating levers have an outwardly turned lip around most of the perimeter to rigidify and reinforce the actuating lever. This edge of the lip can be sharp and uncomfortable to press with the fingers when attempting to close the rings.

One attempt has been made to provide a cover for an actuating lever, as shown in U.S. Pat. No. 5,234,276. The purpose of the cover therein is to make metal actuating levers easier on the fingers of the binder operator and/or to make the actuating levers longer so that more leverage is available. The cover is formed of two hinged plastic pieces that are snapped together to completely encase the actuating lever. Unfortunately, the plastic cover is susceptible to breakage, especially the tiny interlocking studs which hold the two halves together. The hinge can provide sharp edges, especially at the corners, and the seam between the mating halves can collect dirt and dust. Also, the hinge is susceptible to breakage. In addition, the cover is rigid, and rather large and cumbersome, approximately three times the size of the actuating lever, resulting in an unpleasant appearance.

There is a need in the art for a ring binder having actuating levers which are comfortable to use and slip resistant, and which minimize the feedback of undesirable shock forces produced by the snap action of the rings when opening and closing the rings.

SUMMARY OF THE INVENTION

The present invention fulfills the aforementioned need in the art by providing a ring binder including a substantially rigid curved upper plate supporting a pair of hinged leaves. A plurality of ring members are secured to the hinged leaves for engaging corresponding holes in sheets of material retained by the ring binder. An actuating lever is located at each end of the curved upper plate for actuating the hinged leaves to open and close the ring members.

Each actuating lever includes a tab with a cushion member thereon. The tab has an aperture therein, and a curved perimeter edge which includes a convexly-curved upper edge and a pair of concavely-curved side edges. The cushion member is formed onto the tab, for example by molding, such that cushion material enters the aperture to secure the cushion member onto the tab. In addition, cushion material surrounds the curved perimeter edge of the tab, and particularly the concavely-curved side edges of the tab, to further assist in retaining the cushion member on the tab.

The cushion member is engaged by the fingers of a user to pivot the actuating lever in order to move the ring members between the open position and the closed position. The cushion member is a soft pad of resilient material such as rubber or soft plastic. The cushion member provides improved tactile characteristics to the actuating lever, making the actuating lever comfortable to use. The cushion member also minimizes the feedback of undesirable shock forces produced by the snap action of the rings when opening and closing the rings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENT

Figure 1:
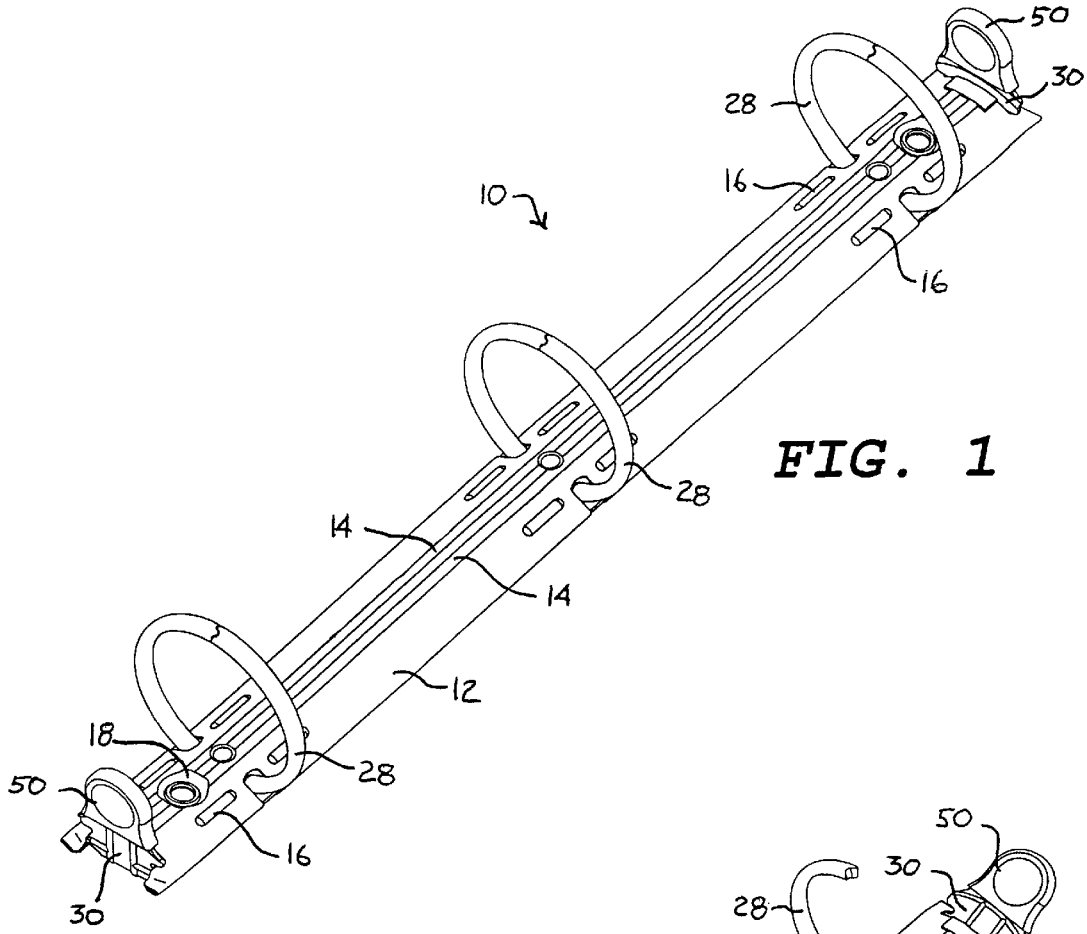
FIG. 1 is a perspective view showing the upper side of the ring binder of the present invention with the rings in a closed position.
Figure 2:
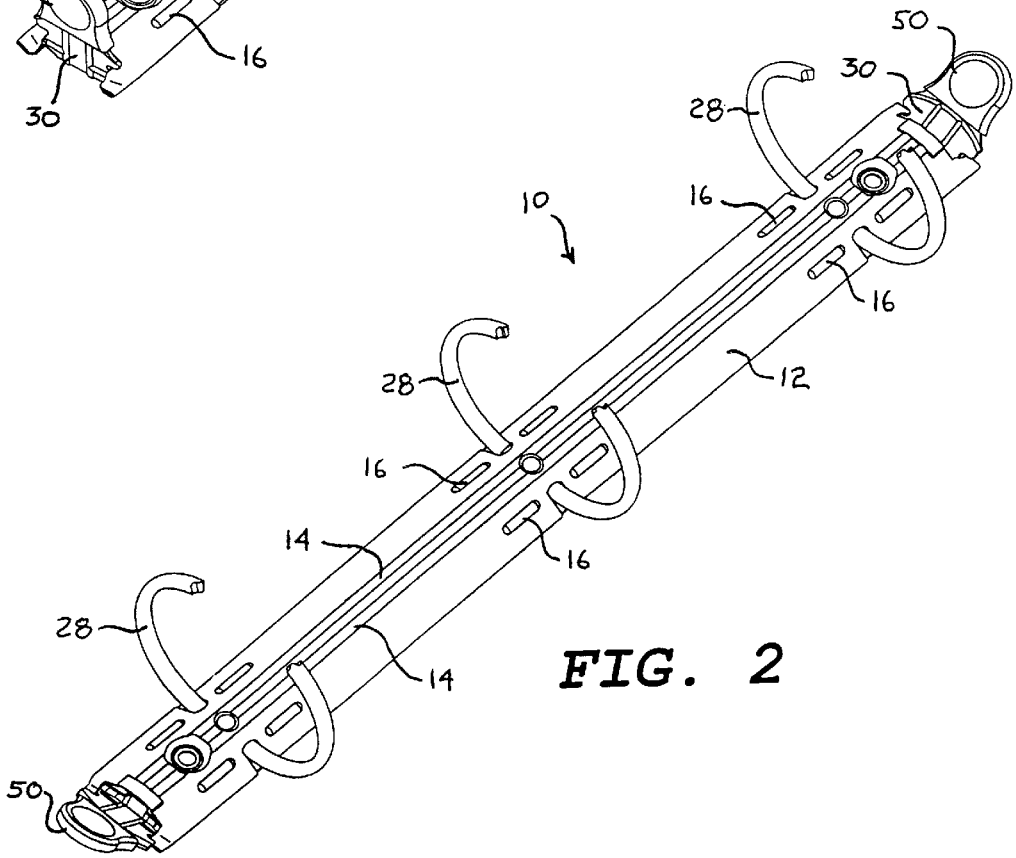
FIG. 2 is a perspective view showing the upper side of the ring binder of the present invention with the rings in an open position.
Figure 3:
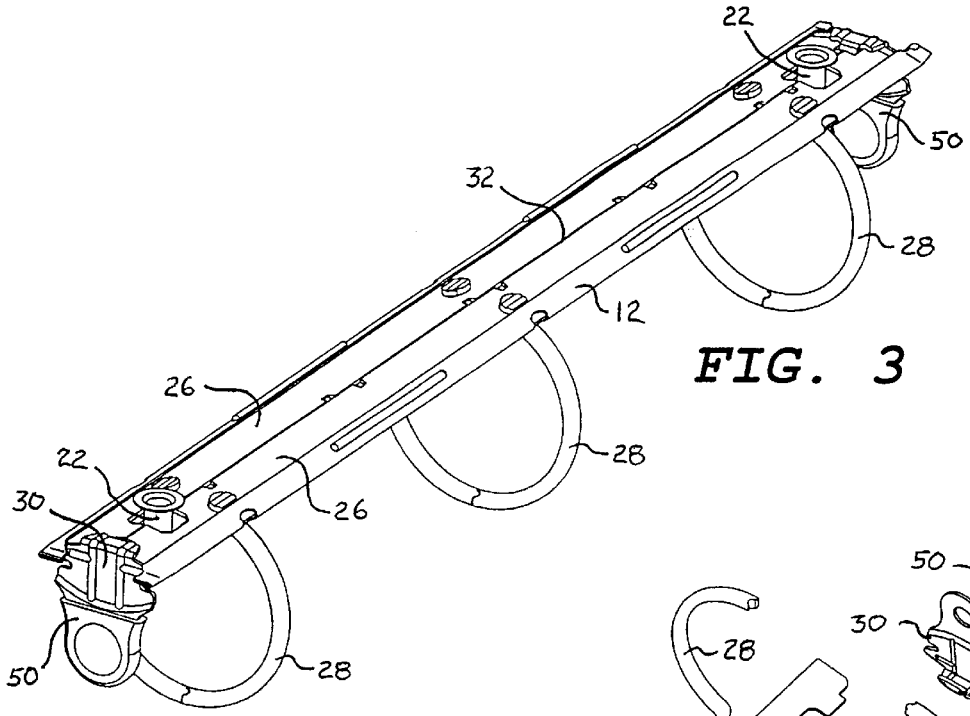
FIG. 3 is a perspective view showing the underside of the ring binder.
Figure 4:
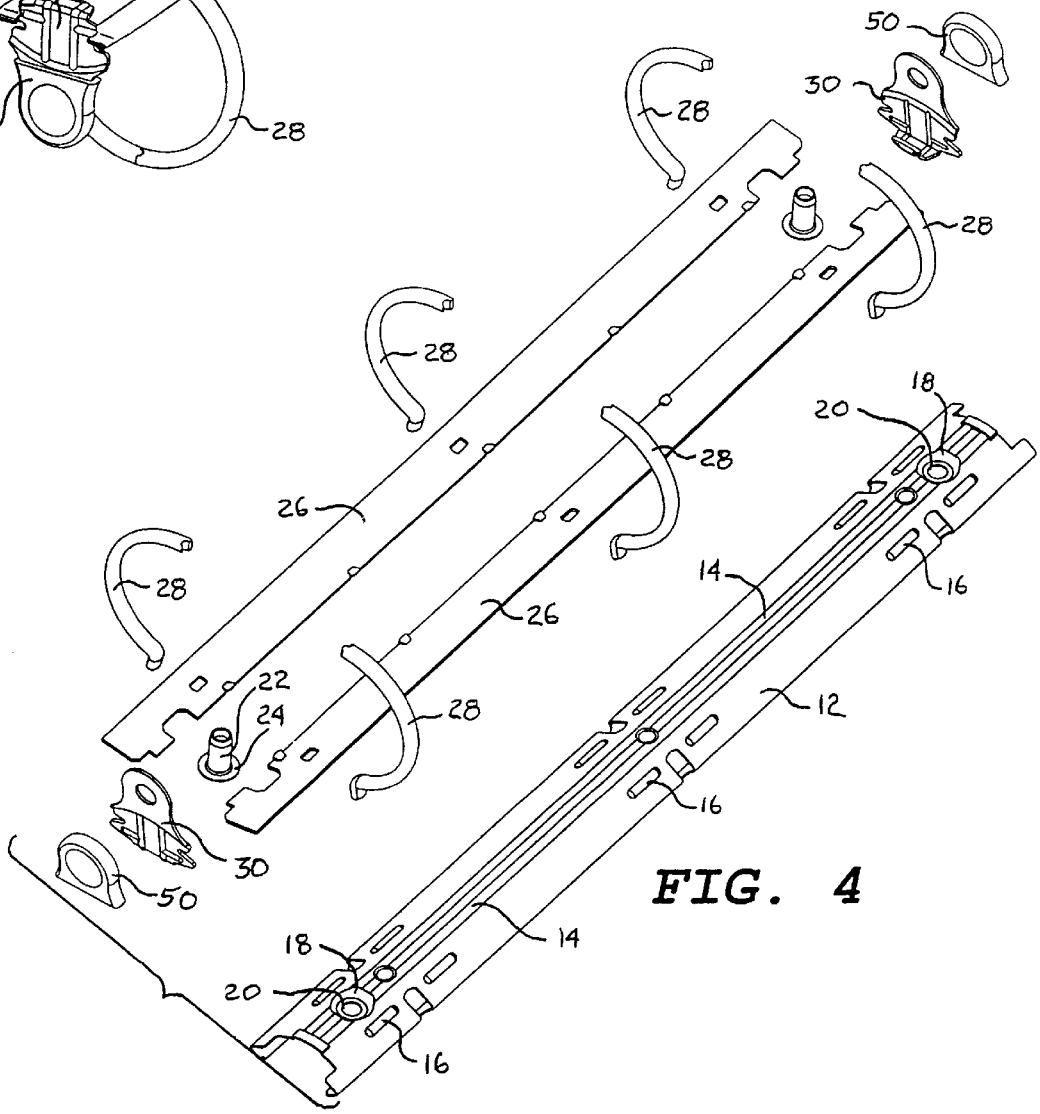
FIG. 4 is an exploded perspective view of the ring binder.

Referring in detail to the drawings, and with particular reference to FIGS. 1–4, a ring binder of the present invention is shown. The ring binder 10 is securable to a cover member (not shown) to produce a loose-leaf binder. The cover member preferably includes a spine located between front and back covers of the cover member. The ring binder 10 may be attached to the cover member by any conventional fasteners, such as rivets, which extend through the cover member and which are deformed, for example, by punching, to securely and permanently fix the ring binder 10 to the cover member.

The ring binder 10 includes a substantially rigid curved upper plate 12. The curved upper plate 12 includes a pair of first reinforcing ribs 14 extending longitudinally along the center thereof which protrude upwardly and outwardly from an outer surface of the curved upper plate 12, thereby increasing the resistance of the curved upper plate 12 to bending. The first ribs 14 extend substantially along the entire length of the curved upper plate 12 from one end to another. The curved upper plate 12 further includes several pairs of second ribs 16 which protrude upwardly and outwardly from an outer surface of the curved upper plate 12 and which are located outwardly of the first ribs 14.

The curved upper plate 12 further includes a depression 18 near each end thereof. Each depression 18 includes an aperture 20 extending through the curved upper plate 12. A cylindrical post 22 is attached to the curved upper plate 12 at the depression 18. One end of the cylindrical post 22 is secured within the aperture 20, for example, by pressing. The other end of the cylindrical post 22 has a flange 24 which forms a base for the ring binder 10 for attachment to the cover.

A pair of hinged leaves 26 are supported by the curved upper plate 12. The curved upper plate 12 provides a biasing force on the hinged leaves 26 such that the hinged leaves 26 move in an over-center manner. A plurality of ring members 28 are secured to the hinged leaves 26 for engaging corresponding holes in sheets of material retained by the ring binder 10.

An actuating lever 30 is located at each end of the curved upper plate 12 for actuating the hinged leaves 26 to open and close the ring members 28. When the ring members 28 of the ring binder 10 are in a closed position, movement of the actuating levers 30 away from one another causes a central hinge portion 32 of the hinged leaves 26 to move toward the curved upper plate 12, thereby causing the ring members 28, which move with the hinged leaves 26, to move to an open position. Conversely, when the ring members 28 of the ring binder 10 are in an open position, movement of the actuating levers 30 toward one another causes the central hinge portion 32 of the hinged leaves 26 to move away from the curved upper plate 12, thereby causing the ring members 28 to return to the closed position. A known ring binder including a conventional opening/closing mechanism with an actuating lever is more fully disclosed in U.S. Pat. No. 5,354,142, the entire contents of which are hereby incorporated by reference.

Referring now to FIGS. 5–10, an actuating lever 30 of the present invention is shown, which includes a main body 34 made of metal having a nickel plated finish. Each actuating lever 30 includes a plurality of reinforcing ribs 36 thereon to increase the rigidity of the main body 34. The main body 34 further includes a pair of grooves 38 on opposite side edges which form a pivot axis of the actuating lever 30. A lower portion of the main body 34 includes a hook member 40 which engages and moves the hinged leaves 26. An upper portion of the main body 34 is the portion engaged by the fingers of the user to pivot the actuating lever 30 about the pivot axis defined by the grooves 38, in order to open and close the ring members 28 of the ring binder 10.

Figure 5:
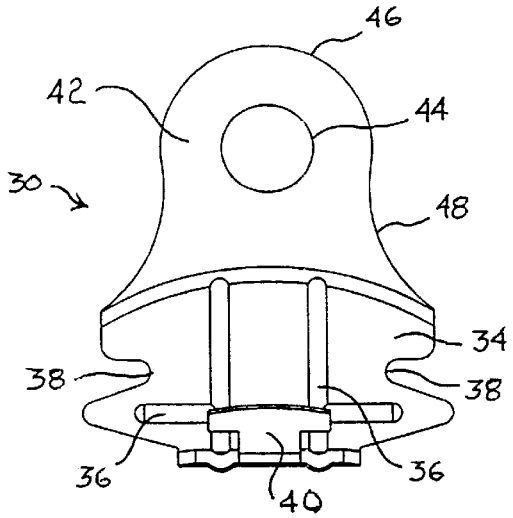
FIG. 5 is a view of the inner side of the actuating lever of the present invention with the cushion member removed therefrom.
Figure 6:
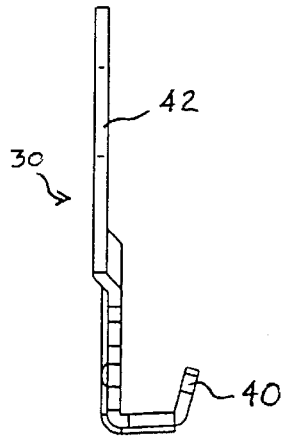
FIG. 6 is a side view of the actuating lever of the present invention with the cushion member removed therefrom.

The upper portion of the main body 34 includes a substantially flat tab 42 having an aperture 44 therein. The tab 42 has a curved perimeter edge which includes a convexly-curved upper edge 46 and a pair of concavely-curved side edges 48. The curvature of the concavely-curved side edges 48 flows smoothly into the convexly-curved upper edge 46, as shown in FIG. 5.

Figure 7:
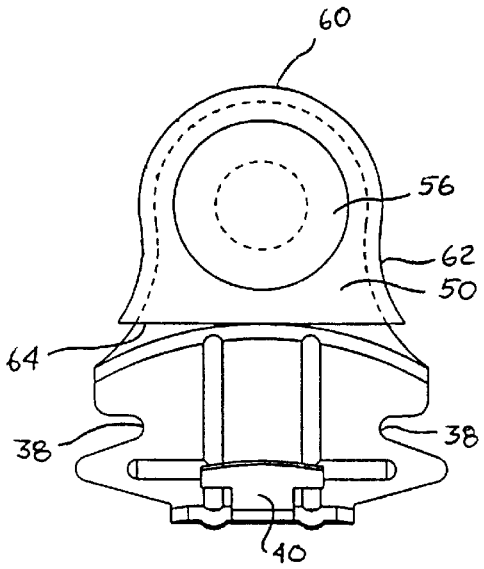
FIG. 7 is a view of the inner side of the actuating lever with the cushion member thereon.
Figure 8:
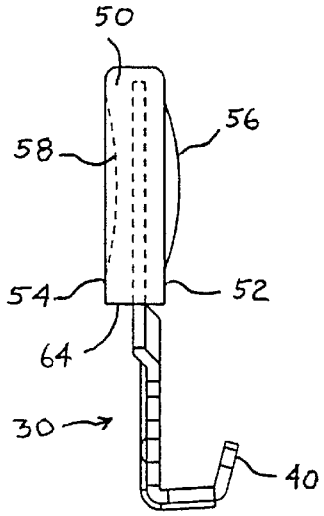
FIG. 8 is a side view of the actuating lever with the cushion member thereon.
Figure 9:
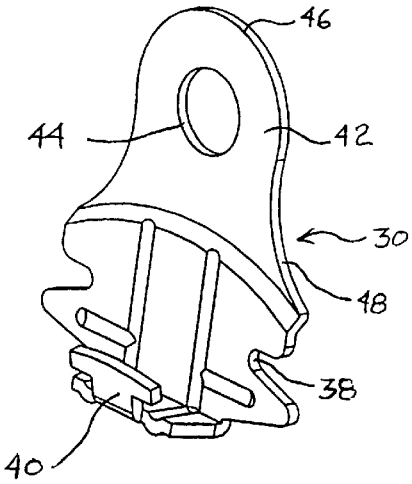
FIG. 9 is a perspective view of an inner side of the actuating lever without the cushion member thereon.
Figure 10:
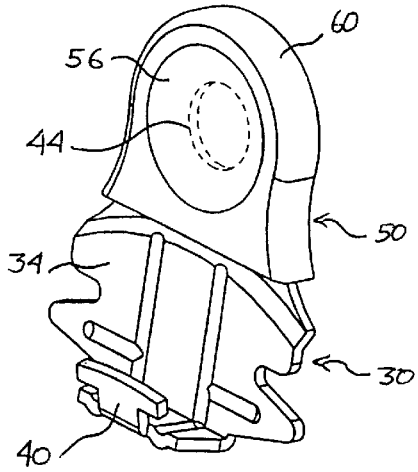
FIG. 10 is a perspective view of the inner side of the actuating lever with the cushion member thereon.

Referring now to FIGS. 7 and 8, a cushion member 50 of the present invention is shown. The cushion member 50 generally surrounds the tab 42 and is preferably only slightly larger than the size of the tab 42, as shown in FIG. 7. The cushion member 50 is large enough to cover the tab 42 so that the user's fingers do not touch any rough edges which may exist on the tab 42, but instead touch the soft face of the cushion member 50. The cushion member 50 is a soft pad of resilient material, which is preferably formed of plastic, rubber, or an elastomeric material.

The cushion member 50 has an inner face 52 and an outer face 54. The inner face 52 refers to the face closest to the rings 28 when the cushion member 50 is installed on the tab 42, and the outer face 54 refers to the face furthest from the rings 28 when the cushion member 50 is installed on the tab 42. The inner face 52 is engaged by the finger of a user to pivot the actuating lever 30 to move the ring members 28 to the open position, and the outer face 54 is engaged by the finger of a user to pivot the actuating lever 30 to move the ring members 28 to the closed position. A convex projection 56 is located on the inner face 52 of the cushion member 50, and the outer face 54 of the cushion member 50 has a concave dimple 58 therein.

In the preferred embodiment shown in FIGS. 7, 8, 10 and 11, the cushion member 50 is molded onto the tab 42 such that the cushion member 50 is a one-piece unitary integral member. To form the cushion member 50 on the tab 42, the actuating lever 30 is placed into a molding machine (not shown), with the tab 42 encased in an injection mold of the machine. The machine then injects melted cushion material, such as plastics, into the mold, and the cushion member 50 is thus formed snugly around the tab 42.

Figure 11:
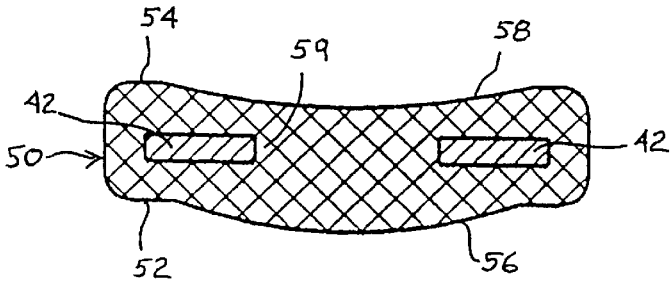
FIG. 11 is a cross-sectional view of the cushion member of the present invention.

Because the tab 42 includes an aperture 44 therein, material of the cushion member 50 passes into the aperture 44 to form a pin 59 in the shape of a circular dowel, as shown in FIG. 11, to securely hold the cushion member onto the tab 42. In addition, as shown in FIGS. 7 and 8, the cushion member 50 has a perimeter wall including an outwardly-curved upper wall 60 and a pair of inwardly-curved side walls 62, so that the perimeter wall contour of the cushion member 50 generally follows and covers the perimeter edges 46,48 of the tab 42. The cushion member 50 further includes a generally straight lower wall 64.

In a preferred embodiment, the minimum width dimension between the concavely-curved side edges 48 of the tab 42 is preferably less that the maximum width dimension of the convexly-curved upper edge 46 of the tab so as to form a constricted neck area of the tab 42. Thus, when the cushion member 50 is formed onto the tab 42, the cushion material of the inwardly-curved side walls 62 is located against the concavely-curved side edges 48 of the tab 42 in the constricted neck portion of the tab 42 to help secure the cushion member 50 to the tab 42. Alternatively, the present invention may be applied to a tab 42 without a constricted neck portion and the dimensional relationships described above.

Although the cushion member 50 is preferably formed of plastic, it is conceived that other cushioning materials such as rubber, elastomers, dense foam, or any suitable moldable material may be utilized. Also, the cushion member 50 may be formed of different colors to coordinate the ring binder 10 with the cover member, or with the subject matter of the items contained within the loose-leaf binder.

Although the main body 34 of the actuating lever 30 is made of stamped metal having a nickel plated finish, it is possible to utilize other suitable strong and rigid materials, such as plastic, without departing from the invention.

It should be understood that while the preferred embodiment describes the ring binder 10 as being attached to the spine of the cover member, the ring binder may instead be attached to the front cover or the back cover. Also, although three ring members 28 are shown in FIGS. 1–4, it should be understood that any number and arrangement of ring members 28 may be utilized. For example, two or four ring members may be utilized. Also, the ring members 28 may be equally spaced-apart, or may have different spacings. Finally, although the ring members 28 shown are circular, it is envisioned that D-shaped or other ring shapes may be utilized.

Although the actuating lever cushion member 50 of the present invention has been described for use with a ring binder having a curved upper plate 12 with a pair of first reinforcing ribs 14 and several pairs of second ribs 16, it should be understood that the actuating lever cushion member 50 may be used with differently shaped upper plates which do not include reinforcing ribs.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A ring binder comprising:

an upper plate;

a pair of hinged leaves supported by said upper plate;

a plurality of rings attached to said hinged leaves and movable therewith;

at least one pivotable actuating lever for moving said hinged leaves from a first position where said rings are closed, to a second position where said rings are open, said actuating lever including a tab at an upper end portion thereof, said tab having a perimeter edge, said tab further having an aperture therein; and a cushion member extending over said perimeter edge of said tab and surrounding said tab, said cushion member including a pin projecting into said aperture of said tab to securely attach said cushion member to said actuating lever.

2. The ring binder according to claim 1, wherein said aperture is circular, and said pin comprises a circular dowel of cushion member material which passes through said aperture.

3. The ring binder according to claim 1, wherein said cushion member is formed as a one-piece unitary integral member.

4. The ring binder according to claim 1, wherein said cushion member is formed of plastics.

5. The ring binder according to claim 1, wherein said cushion member has an inner face and an outer face, one of said inner face and said outer face having a convex protrusion, and the other of said inner face and said outer face having a concave dimple therein.

6. The ring binder according to claim 1, wherein said tab has a perimeter edge with a neck portion having a reduced width as compared with a relatively larger width of an upper portion of said tab, and said cushion member has perimeter side portions which project into said neck portion of said tab to securely attach said cushion member to said actuating lever.

7. The ring binder according to claim 6, wherein said perimeter edge of said tab includes a convexly-curved upper edge and a pair of concavely-curved side edges, said concavely-curved side edges comprising said neck portion.

8. The ring binder according to claim 7, wherein said perimeter side portions of said cushion member include a pair of inwardly-curved side walls which are located in said neck portion of said tab to secure said cushion member to said tab.

9. The ring binder according to claim 8, wherein said aperture is circular, and said pin comprises a circular dowel of cushion member material which passes through said aperture.

10. The ring binder according to claim 9, wherein said cushion member has an inner face and an outer face, one of said inner face and said outer face having a convex protrusion, and the other of said inner face and said outer face having a concave dimple therein.

11. In combination, a ring binder having a pivotable actuating lever including a tab at an upper end portion thereof, said tab having a perimeter edge, said tab further having an aperture therein, and a cushion member extending over said perimeter edge of said tab and surrounding said tab, said cushion member including a pin projecting into said aperture of said tab to securely attach said cushion member to said actuating lever.

12. The combination according to claim 11, wherein said aperture is circular, and said pin comprises a circular dowel of cushion member material which passes through said aperture.

13. The combination according to claim 11, wherein said cushion member is formed as a one-piece unitary integral member.

14. The combination according to claim 11, wherein said cushion member is formed of plastics.

15. The combination according to claim 11, wherein said cushion member has an inner face and an outer face, one of said inner face and said outer face having a convex protrusion, and the other of said inner face and said outer face having a concave dimple therein.

16. The combination according to claim 11, wherein said tab has a perimeter edge with a neck portion having a reduced width as compared with a relatively larger width of an upper portion of said tab, and said cushion member has perimeter side portions which project into said neck portion of said tab to securely attach said cushion member to said actuating lever.

17. The combination according to claim 16, wherein said perimeter edge of said tab includes a convexly-curved upper edge and a pair of concavely-curved side edges, said concavely-curved side edges comprising said neck portion.

18. The combination according to claim 17, wherein said perimeter side portions of said cushion member include a pair of inwardly-curved side walls which are located in said neck portion of said tab to secure said cushion member to said tab.

19. The combination according to claim 18, wherein said aperture is circular, and said pin comprises a circular dowel of cushion member material which passes through said aperture.

20. The combination according to claim 19, wherein said cushion member has an inner face and an outer face, one of said inner face and said outer face having a convex protrusion, and the other of said inner face and said outer face having a concave dimple therein.

* * * * *